US007325836B2

(12) United States Patent
Eckhardt

(10) Patent No.: US 7,325,836 B2
(45) Date of Patent: Feb. 5, 2008

(54) COMBINED CLAMP AND RETAINING PIN

(75) Inventor: Richard Eckhardt, Arlington, MA (US)

(73) Assignee: Trainer's Warehouse, Natick, MA (US)

( * ) Notice: Subject to any disclaimer, the term of this patent is extended or adjusted under 35 U.S.C. 154(b) by 641 days.

(21) Appl. No.: 10/783,930

(22) Filed: Feb. 20, 2004

(65) Prior Publication Data

US 2004/0216282 A1 Nov. 4, 2004

Related U.S. Application Data

(60) Provisional application No. 60/449,742, filed on Feb. 24, 2003.

(51) Int. Cl.
*B42D 17/00* (2006.01)
*A47B 97/04* (2006.01)

(52) U.S. Cl. ..... 281/50; 281/49; 24/67.3; 24/499; 248/447

(58) Field of Classification Search ..... 248/441.1, 248/445, 447, 447.1, 447.2, 455, 456; 281/49, 281/50, 44, 45; 24/67.3, 499, 504, 609, 611
See application file for complete search history.

(56) References Cited

U.S. PATENT DOCUMENTS

| | | | | |
|---|---|---|---|---|
| 362,680 | A * | 5/1887 | Tischer | 211/57.1 |
| 538,712 | A * | 5/1895 | Stuart | 402/29 |
| 979,806 | A * | 12/1910 | Snyder | 150/136 |
| 1,060,795 | A * | 5/1913 | Smith | 248/447.2 |
| 1,434,511 | A * | 11/1922 | Swanson | 402/4 |
| 3,827,109 | A * | 8/1974 | Langwell | 24/67.5 |
| 3,949,869 | A * | 4/1976 | Rand | 281/27.1 |
| 3,968,546 | A * | 7/1976 | Seaborn et al. | 24/67.9 |
| 4,241,477 | A * | 12/1980 | Freedom et al. | 24/67 R |
| 4,250,639 | A * | 2/1981 | Tarrant | 40/107 |
| 4,436,271 | A * | 3/1984 | Manso | 248/460 |
| 4,675,953 | A | 6/1987 | Higgs | |
| 4,735,393 | A * | 4/1988 | Albee, Jr. | 248/452 |
| 4,867,594 | A * | 9/1989 | Poulouin | 402/70 |
| 4,934,648 | A * | 6/1990 | Yueh | 248/442.2 |
| 4,955,576 | A * | 9/1990 | Moberg | 248/449 |
| 5,152,490 | A * | 10/1992 | Deutsch | 248/452 |
| 5,379,492 | A * | 1/1995 | Glesser | 24/3.11 |
| 5,472,288 | A * | 12/1995 | Deutsch et al. | 402/4 |
| 6,213,517 | B1 * | 4/2001 | Goluszka et al. | 281/45 |
| 6,802,486 | B2 * | 10/2004 | Weingartner | 248/454 |
| 6,971,616 | B1 * | 12/2005 | Lake | 248/252 |

FOREIGN PATENT DOCUMENTS

GB 475933 * 11/1937

* cited by examiner

*Primary Examiner*—Monica Carter
*Assistant Examiner*—Eric A. Gates
(74) *Attorney, Agent, or Firm*—John E. Toupal; Harold G. Jarcho; M. Brad Lawrence

(57) ABSTRACT

A retainer including a pin adapted for attachment to a mounting member for supporting a stack of sheets having one or more openings; the pin having a shank portion for insertion into the one opening, an outer end portion defining a pair of parallel bores with transversely spaced apart axes, and an inner end portion attachable to the support member; and a spring clamp having a pair of leg portions with outer end portions joined by a yoke portion and inner ends each joined to a journal portion received by a different one of the bores and retainer.

16 Claims, 4 Drawing Sheets

COMBINED CLAMP AND RETAINING PIN

This application claims the benefit of Provisional Patent Application Ser. No. 60/449,742 filed on Feb. 24, 2003, entitled Combined Clamp and Retaining Pin.

BACKGROUND OF THE INVENTION

Many applications exist in which sheets or pads of paper are mounted on a display rack. Typically, pins secured to the racks receive holes in the paper and thus retain it in a desired portion. Although suitable for other such applications the present invention is a combination clip and pin retainer described in connection with an artist's easel which employs a flip chart pad having a quantity of individual paper sheets.

A variety of spring clip mechanisms have been developed for securing together various items. Typical examples of such mechanism are disclosed, for example, in U.S. Pat. Nos. 4,675,953 and 5,379,492. Prior spring clip mechanisms, however, exhibit structural features which limit their use for applications such as the retention of stacked sheets of paper which are to be removed individually from a supporting base. The object of this invention, therefore, is to provide an improved spring clip retainer for use in such applications.

SUMMARY OF THE INVENTION

The invention is a retainer including a pin adapted for attachment to a mounting member for supporting a stack of sheets having one or more openings; the pin having a shank portion for insertion into the one opening, an outer end portion defining a pair of parallel bores with transversely spaced apart axes, and an inner end portion attachable to the support member; and a spring clamp having a pair of leg portions with outer end portions joined by a yoke portion and inner ends each joined to a journal portion received by a different one of the bores and retainer. The pin facilitates stacking and removal of plural sheets from the mounting member.

According to one feature of the invention, the outer end portion is displaced a substantial distance d from the inner end portion. This feature allows use of the pin with a relatively thick stack of sheets.

According to another feature of the invention, the distance d is substantially greater than a maximum width W of the pin. This feature provides the pin with a desirable structural scale.

According to yet another feature of the invention, the leg portions are non-parallel and have equal lengths, and the bores lie in a plane oriented obtusely to the stack of sheets. These features enhance operational flexibility of the retainers.

According to a further feature of the invention, the pin is cylindrical and the outer end defines a pair of substantially planar, parallel surfaces penetrated by said bores; the shank portion has outer beveled surface portions intersecting the parallel surfaces, and a tip of the outer end portion is inwardly tapered. These features facilitate insertion of the retainer into holes in the sheets.

According to yet another feature of the invention, the shank portion and the inner end portion define an axial threaded bore. The threaded bore simplifies mounting of the retainer on a mounting surface.

DESCRIPTION OF THE DRAWINGS

The invention will become more apparent upon a perusal of the following description taken in conjunction with the accompanying drawings wherein.

DESCRIPTION OF THE EMBODIMENT

Figure 1:
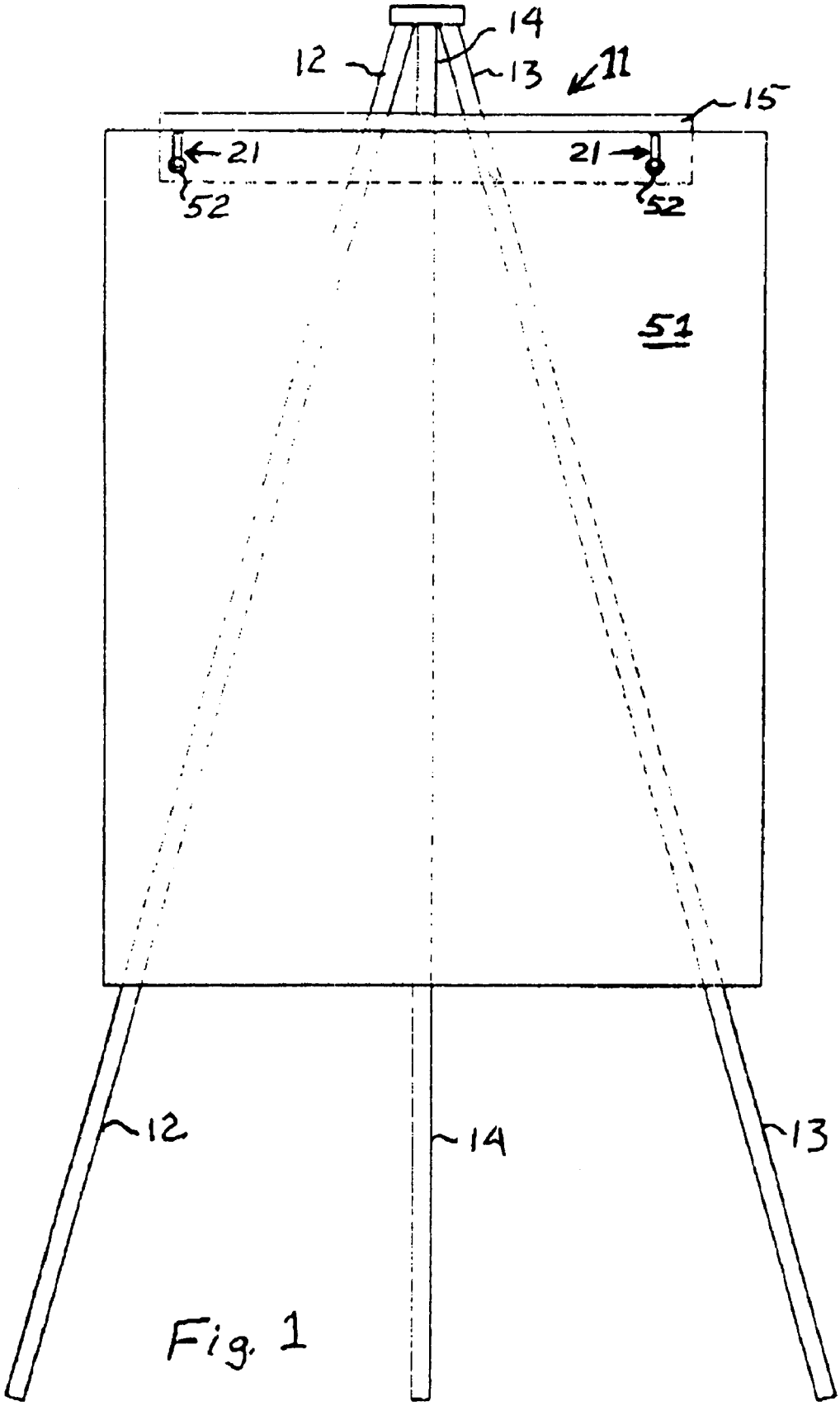
FIG. 1 is a front view of an easel including a retainer device according to the invention.

An easel 11 having tripod legs 12-14 and a horizontally extending mounting support bar 15 supported on legs 12 and 13 is shown in FIG. 1. Mounted on the bar 15 are a pair of retainer devices 21 which function to support and retain a sketch pad composed of a stack of paper sheets 51. A lower portion 23 of the pad is supported by the legs 12 and 13.

Figure 3:
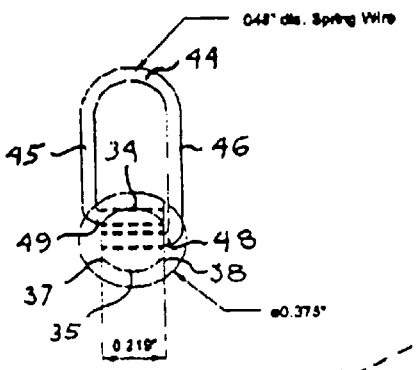
FIG. 3 is a front view of the retainer device shown in FIG. 2.
Figure 2:
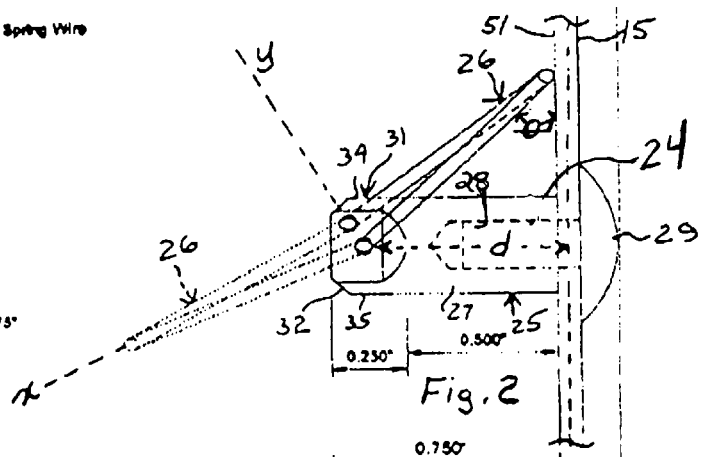
FIG. 2 is a partial side view of the easel and retainer device shown in FIG. 11.

Illustrated in FIGS. 2 and 3 is one of the retainer devices 21 which includes a cylindrical pin 25 and a spring clamp 26 pivotally coupled to an outer end of the pin 25. Inner end and shank portions 24 and 27, respectively, of the pin define a threaded bore 28. Received by the bore 28 is a screw 29 which secures the pin 25 to the bar 15. The pin 25 has an outer end portion 31 terminated by an inwardly tapered tip 32.

Figure 4:
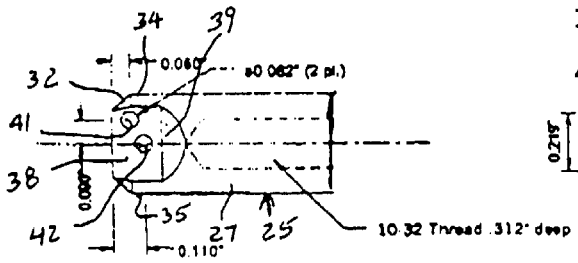
FIG. 4 is a side view of a pin component of the retainer device shown in FIGS. 2 and 3.
Figure 5:
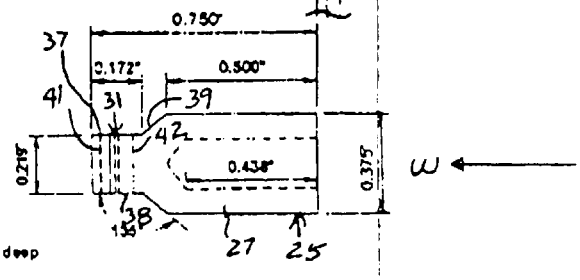
FIG. 5 is a top view of the pin component shown in FIG. 4.

As shown in FIGS. 4 and 5, the outer end portion 31 includes cylindrical upper and lower surfaces 34, 35 extending from cylindrical surfaces of the shank portion 25. Joining the surfaces 34, 35 are parallel planar surfaces 37, 38 which intersect inwardly the shank portion 25. The vertical surfaces 37, 38 rejoined to the shank portion 25 by beveled surfaces 39. Projecting between the planar surfaces 37, 38 are a pair of parallel, spaced apart bores 41, 42 with axes spaced apert in a direction transverse to the longitudinally projecting shank and outer end portions 25 and 31.

Figure 6:
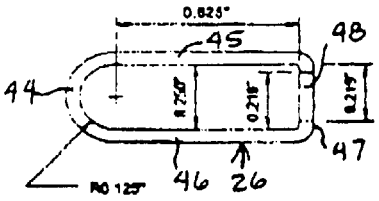
FIG. 6 is a top view of a clamp component of the retainer device shown in FIGS. 2 and 3.
Figure 7:
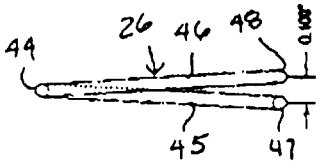
FIG. 7 is a side view of the clamp component shown in FIGS. 2 and 3.
Figure 9:
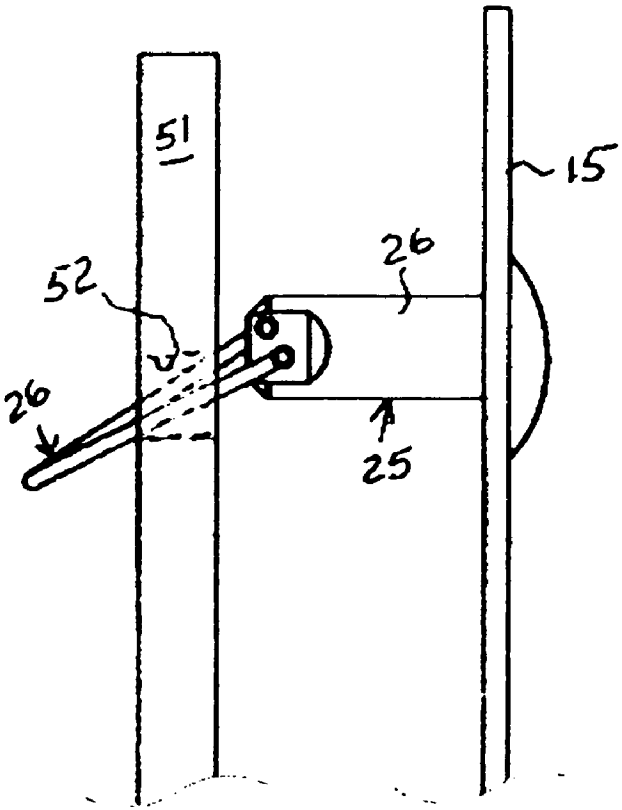
FIGS. 8 and 9 are front and side views, respectively, illustrating a pad being positioned over the retainer device of FIGS. 2 and 3.
Figure 8:
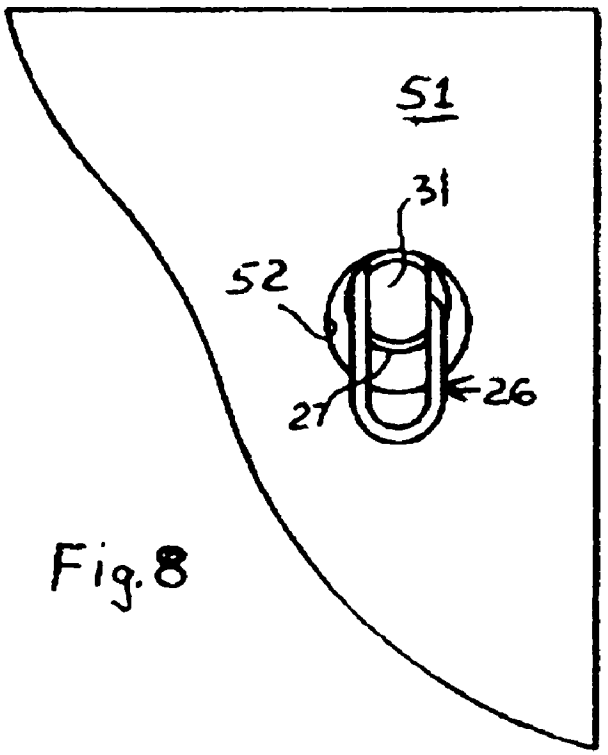
Figure 11:
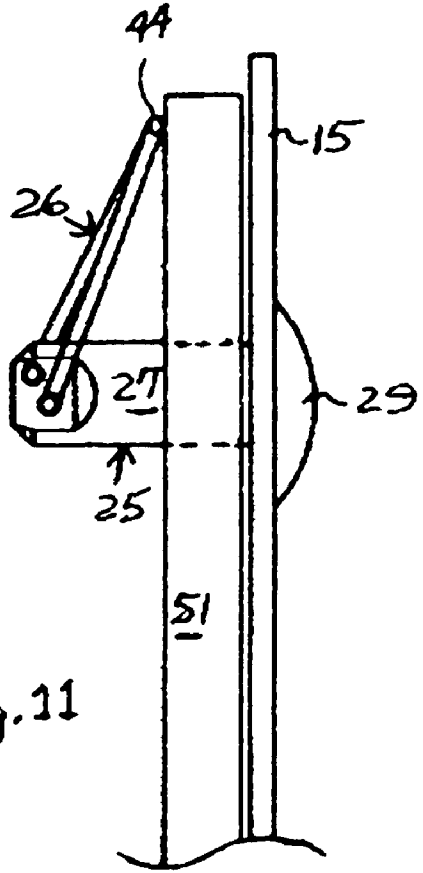
FIGS. 10 and 11 are front and side views, respectively, illustrating the pad of FIGS. 8 and 9 fully mounted and clamped in position by the retainer device of FIGS. 2 and 3.
Figure 10:
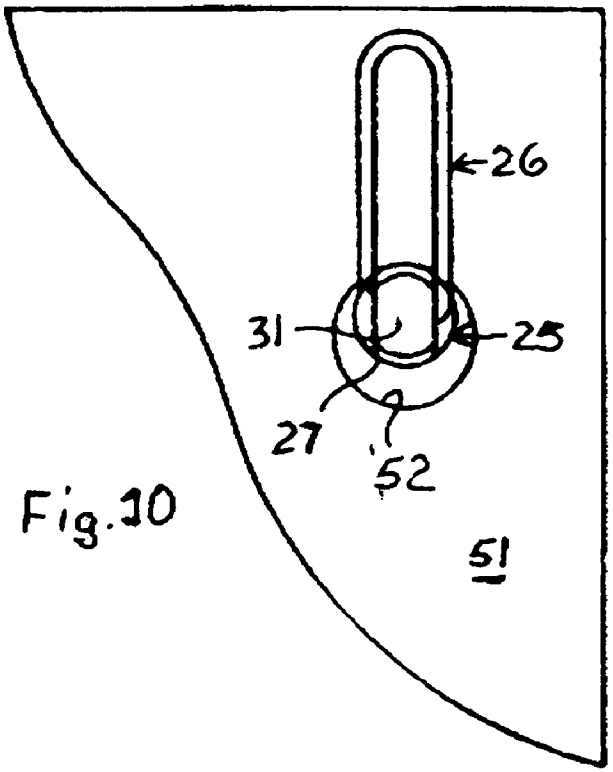

The clamp 26 (FIGS. 6 and 7)is formed of spring wire and has an outer U-shaped yoke portion 44. Joined to the outer yoke portion 44 are elongated non-parallel leg portions 45, 46 of uniform length with spaced apart, parallel journal ends 47, 48, respectively, projecting transversely inwardly in opposite directions. Although parallel legs could also be used, the use of non-parallel legs simplifies assembly of the clamp 26 on the pin 25. Inner ends of the leg portions 45, 46 are joined, respectively, to the journal end portions 47, 48 and received by the bores 41, 42 to pivotally couple the clamp 26 to the pin 25. Once attached to the pin 25, the clamp 26 can be pivoted between a stable open position shown by dashed lines in FIG. 2 and a closed position shown by solid lines. In its stable open position, the clamp 26 is aligned on an axis x extending midway between the bores 41, 42 and perpendicular to a plane y encompassed thereby. From its closed position the clamp 26 can be pivoted against one sense of spring torque force into alignment with the plane y after which spring torque force in the opposite sense pivots the outer end 44 into engagement with the paper sheets 51 supported by the pins 25 and the bar 15.

Loading onto the easel 11 the stack or pad of paper 51 having openings 52 spaced apart the same distance as the spacing between the devices 21 is accomplished as depicted in FIGS. 8-11. The spring clamp 26 on each pin 25 is pulled outwardly until it snaps into its stable open position. The paper 51 is then loaded onto the pins 25 (FIGS. 8 and 9) by aligning and guiding the holes 52 over the aligned clamps 26 and pins 25. This procedure is facilitated by the tapered tip 32 and beveled surfaces 39 on the pin 25. The clamps 26 then are pivoted into a biased closed position engaging the paper 51 retained on the pins. In this position, the paper 51 can not slide off the pin 25 without pulling the clamp 26 back to the open position, which requires a significant force. The bores 41, 42 can be oriented such that the clamp 26 continues to exert force against the paper 51 to hold it securely, or such that in a closed stable position aligned with the axis x the clamp does not apply pressure on the paper while preventing its removal from pin 25.

The clamp 26 operates in this way because two journals 47, 48 are fitted into the spaced apart bores 41, 42 creating two different non-aligned pivot points. When the center of the clamp 26 is on the axis x, the only force on the clamp is to spread the two legs 45, 46 and it remains stable in this position. When the clamp is pivoted, the length of the two spring legs 45, 46 are forced to be different, by flexing of the spring material and stores energy which exerts a force to return the clamp to a stable position. This force is maximum when the spring is rotated to a position in the plane y, where the different length of the legs 45, 46 is maximum. If released, the spring will quickly snap to the nearest stable position or into engagement with the paper 51.

The exact size, position, and shape of the pin 25, holes 41, 42, and clamp 26 can vary widely, and can be chosen for the specific application to provide the desired force. Above is an example of a device 21 for holding a display flip chart pad on an easel. Two devices 21 are used to hold the flip chart 51. The pins 25 can hold material up to about 0.5" thick and are designed to pass through a hole at least ⅜" in diameter. They will retain paper with holes ½" in diameter or larger, As described above, this embodiment applies continuous force to the paper on the pins 25. Preferably, the minimum displacement d (FIG. 2) of the nearest bore 42 from the base bar 15 is substantially greater than the maximum width w (FIG. 5) of the pin 25 so as to allow the desirable orientation of the clamp 26 at an acute angle θ (FIG. 2) to the base bar even with a substantial thickness of retained paper 51. Also, the orientation of the bores 41, 42 is preferred to establish the plane y at an obtuse angle to the base bar 15. In that way undesirable movement of the clamp 26 from a clamping position to the stable open position shown in dashed lines is averted in the event of inadvertent movement of the pad 51 forcing the clamp 26 through a vertical position toward the position defined by the plane y.

Obviously, many modifications and variations of the present invention are possible in light of the above teaching. It is to be understood, therefore, that the invention can be practiced otherwise than as specifically described.

What is claimed is:

1. A retainer comprising:

a pin adapted for attachment to a mounting member for supporting a stack of sheets having one or more openings; said pin comprising a shank portion for insertion into the one or more openings, an outer end pin portion having an entirely exposed outer surface, extending longitudinally from said shank portion and defining a pair of transversely extending parallel bores with transversely spaced apart axes, and an inner end pin portion attachable to the mounting member;

a spring clamp comprising a pair of leg portions having outer end clamp portions joined by a yoke portion and inner ends each joined to a journal portion received by a different one of said bores; and wherein said pin is cylindrical and said outer end pin portions define a pair of substantially planar, parallel surfaces penetrated by said bores and wherein said shank portion has outer beveled surface portions intersecting said parallel surfaces.

2. An apparatus according to claim 1 wherein said outer end pin portions are displaced a substantial distance (d) from said inner end pin portions.

3. An apparatus according to claim 2 wherein said distance (d) is substantially greater than a maximum width (W) of said pin.

4. An apparatus according to claim 3 wherein said leg portions are substantially parallel and said yoke portion is elongated and projects transversely from said leg portions.

5. An apparatus according to claim 4 wherein said bores lie in a plane oriented obtusely to a longitudinal axis of said outer end pin portion and to the stack of sheets.

6. An apparatus according to claim 1 wherein said leg portions are non-parallel and have equal lengths.

7. An apparatus according to claim 6 wherein said bores lie in a plane oriented obtusely to the stack of sheets.

8. An apparatus according to claim 1 wherein a tip of said outer end pin portions are inwardly tapered.

9. An apparatus according to claim 8 wherein said shank portion and said inner end pin portions defines an axial threaded bore.

10. An apparatus according to claim 8 wherein said outer end pin portions are displaced a substantial distance (d) from said inner end pin portions.

11. An apparatus according to claim 10 wherein said distance (d) is substantially greater than a maximum width (W) of said pin.

12. An apparatus according to claim 1 wherein said leg portions are substantially parallel and said yoke portion is elongated and projects transversely from said leg portions.

13. An apparatus according to claim 1 wherein a tip of said outer end pin portions is inwardly tapered.

14. An apparatus according to claim 13 wherein said shank portion and said inner end pin portions defines an axial threaded bore.

15. An apparatus according to claim 14 wherein said leg portions are non-parallel and have equal lengths.

16. An apparatus according to claim 1 wherein said bores lie in a plane oriented obtusely to a longitudinal axis of said outer end pin portion and to the stack of sheets.

* * * * *